US012247335B2

(12) United States Patent
Borsoi

(10) Patent No.: US 12,247,335 B2
(45) Date of Patent: Mar. 11, 2025

(54) MACHINE FOR SEWING BAG ENVELOPES

(71) Applicant: BORSOI S.R.L., Vittorio Veneto (IT)

(72) Inventor: Alessandro Borsoi, San Vendemiano (IT)

(73) Assignee: BORSOI S.R.L., Vittorio Veneto (IT)

( * ) Notice: Subject to any disclaimer, the term of this patent is extended or adjusted under 35 U.S.C. 154(b) by 21 days.

(21) Appl. No.: 18/032,161

(22) PCT Filed: Oct. 20, 2021

(86) PCT No.: PCT/IB2021/059660
§ 371 (c)(1),
(2) Date: Apr. 14, 2023

(87) PCT Pub. No.: WO2022/084878
PCT Pub. Date: Apr. 28, 2022

(65) Prior Publication Data

US 2023/0392311 A1 Dec. 7, 2023

(30) Foreign Application Priority Data

Oct. 21, 2020 (IT) ..... 102020000024865

(51) Int. Cl.
*D05B 13/02* (2006.01)
*D05B 21/00* (2006.01)
(Continued)

(52) U.S. Cl.
CPC ..... *D05B 13/02* (2013.01); *D05B 21/00* (2013.01); *D05B 35/102* (2013.01); *D05B 81/00* (2013.01)

(58) Field of Classification Search
CPC ..... D05B 13/02; D05B 21/00; D05B 35/102; D05B 81/00
See application file for complete search history.

(56) References Cited

U.S. PATENT DOCUMENTS 4,624,198 A * 11/1986 Beam ..... D05B 25/00 112/141
4,754,717 A 7/1988 Heinze et al.
(Continued)

FOREIGN PATENT DOCUMENTS

CN 208104732 U 11/2018
EP 0417658 A1 * 3/1991
(Continued)

*Primary Examiner* — Danny Worrell
(74) *Attorney, Agent, or Firm* — Carmel Patent Agency; Robert Ballarini

(57) ABSTRACT

Machine for sewing envelopes into pouches, in correspondence with an opening delimited by two free overlapping flaps, the machine includes a support base; a sewing head, mechanically mounted on the support base, configured to make a sewing line along a sewing direction; retaining means for retaining the free flaps of said envelope like a bag; first movement means for realizing a relative movement between said sewing head and the holding means along a first movement direction substantially parallel to the sewing line; second movement means for moving the sewing head and/or holding means at least along a second movement direction orthogonal with respect to the first movement direction; at least a first sensor configured to detect an extremal edge of the free edges; at least one electronic control unit for generating the relative motion between the support base and/or the holding means along the second movement direction.

20 Claims, 11 Drawing Sheets

(51) Int. Cl.
*D05B 35/10* (2006.01)
*D05B 81/00* (2006.01)

(56) References Cited

U.S. PATENT DOCUMENTS

| | | | | | |
|---|---|---|---|---|---|
| 4,893,574 | A * | 1/1990 | O'Neal | D05B 25/00 | 112/475.08 |
| 5,133,273 | A * | 7/1992 | Brocklehurst | D05B 25/00 | 112/475.08 |
| 5,325,802 | A * | 7/1994 | Stutznacker | D05B 11/00 | 198/470.1 |
| 5,333,561 | A * | 8/1994 | Katou | D05B 23/00 | 112/470.13 |
| 6,189,470 | B1 | 2/2001 | Root et al. | | |
| 6,499,416 | B2 * | 12/2002 | Stewart | D05B 35/02 | 112/470.16 |

FOREIGN PATENT DOCUMENTS

| | | | |
|---|---|---|---|
| EP | 3680188 | A1 | 7/2020 |
| GB | 2228016 | A | 8/1990 |

* cited by examiner

MACHINE FOR SEWING BAG ENVELOPES

FIELD OF THE INVENTION

The present invention relates to a machine for sewing bag envelopes and an apparatus for handling bag envelopes comprising the aforementioned sewing machine.

In particular, the envelopes can be, for example, made of fabric or other material, and have an opening on one side, and are closed on the remaining sides, so as to take them to a machine configured to perform processing and/or operations on each envelope, for example to fill it with a cushioning material.

In particular, the present invention relates to a machine for sewing fabric envelopes (also called "linings") and an apparatus for handling envelopes, in particular from a pick-up station, in which a plurality of stacked envelopes are arranged, to a filling station where each envelope is filled with a suitable padding material, for example artificial fibers, wool, feathers or synthetic materials (such as foam rubber or rubber latex), to thus obtain a pillow.

BACKGROUND

For the production of pillows and other products (for example upholstered products intended for the furniture, automotive and even toys sectors), recourse to a series of consecutive operations normally carried out by mutually independent stations is already known and in which, in correspondence of each station, the intervention of one or more operators is generally foreseen.

The production process for the preparation of a pillow generally involves the following main steps:

- bagging, in which the stuffing material of the pillow is inserted inside the cover, which generally has the shape of the desired pillow with 3 closed (sewn) sides and one that is at least partially open; suitably, the bagging is performed on the open side;
- seam, within which the open side of the cover is closed, thus completing the pillow.

Conveniently, the process then includes further steps of:

- control and arrangement of the pillow, during which the contents of the pillow are homogenized in all its volume and the most critical points of the cushion are checked, such as corners and seams;
- envelope that involves the insertion of one or more pillow in a packaging envelope;
- closing of the envelope by heat sealing the envelope itself and pressing (to reduce its size) or with specific hinges;
- boxing and palletizing of packaged pillows.

Each of these phases is performed by an at least partially automated operating station.

Currently, the sewing phase is partially automated only in some specific cases. In particular, it is known in the technical sector of reference to use sewing machines equipped with a sewing head able to carry out a sewing line on free flaps of a envelope, in which said envelope is held and moved along a sewing direction directly to hand by an operator.

Obviously, this use of an operator inevitably leads to seams that are different from each other, invalidating the final aesthetic result of the envelopes.

Furthermore, it can often happen that the operator can make a mistake in positioning the free flaps of the envelope, obtaining an inclined seam with respect to the shaft edges and, in the limit, obtaining a seam that for at least a stretch has protruded from the extremal edge of these free flaps, invalidating the usability of the envelope, necessitating a complete redoing of the seam, leading to an increase in production and management costs.

Furthermore, in the event that the seam protrudes from the extreme edge of the free flaps of the envelope, a maintenance action is necessary to realign some sewing components, leading to machine downtime which lengthens production times and increases production costs same.

It is easy to understand how this is not satisfactory since it causes a slowdown in the automated production line, with a consequent decrease in the productivity of the entire plant. Furthermore, these loading operations require the use of dedicated personnel, with a consequent increase in costs.

SUMMARY

The object of the invention is to propose a machine for sewing bag envelopes that overcomes the drawbacks of the aforementioned prior art and an apparatus for handling bag envelopes equipped with at least one sewing machine that are able to guarantee high quality stitching and manufacturing quality.

A further object of the present invention is to provide a machine for sewing bag envelopes which is operationally completely reliable and which in particular allows a large number of seams to be made, obviating the risk of making different sewing lines.

A further object of the present invention is to provide a machine for sewing bag envelopes which requires little maintenance and therefore allows to obtain a high efficiency in making the envelopes.

Another purpose of the invention is to propose a machine for sewing bag envelopes that can also be used with existing and operational machines and/or systems.

Another purpose of the invention is to propose a machine for sewing bag envelopes that is simple and easy to use, as well as reducing maintenance interventions.

Another purpose of the invention is to propose a machine for sewing bag envelopes that can be used with envelopes of substantially any shape, size, material and/or fabric.

Another purpose of the invention is to propose a machine for sewing bag envelopes that has an alternative characterization, both in constructive and functional terms, with respect to traditional ones.

Another purpose of the invention is to propose a machine for sewing bag envelopes that can be used and installed in line in plants for the production of pillows or the like.

Another purpose of the invention is to propose a machine for sewing bag envelopes that allows obtaining pillows of high quality standards.

Another purpose of the invention is to propose a machine for sewing bag envelopes that can be made in a simple, quick and low-cost manner.

These objects, both individually and in any combination thereof, as well as other objects that will emerge from the following description, are achieved, according to the invention, with an apparatus for handling bag-like envelopes as defined in the appended claims.

BRIEF DESCRIPTION OF THE DRAWINGS

The present invention is further clarified hereinafter in a preferred embodiment thereof reported for purely illustrative and non-limiting purposes with reference to the attached drawing tables, in which.

DETAILED DESCRIPTION OF THE PREFERRED EMBODIMENTS

Figure 1:
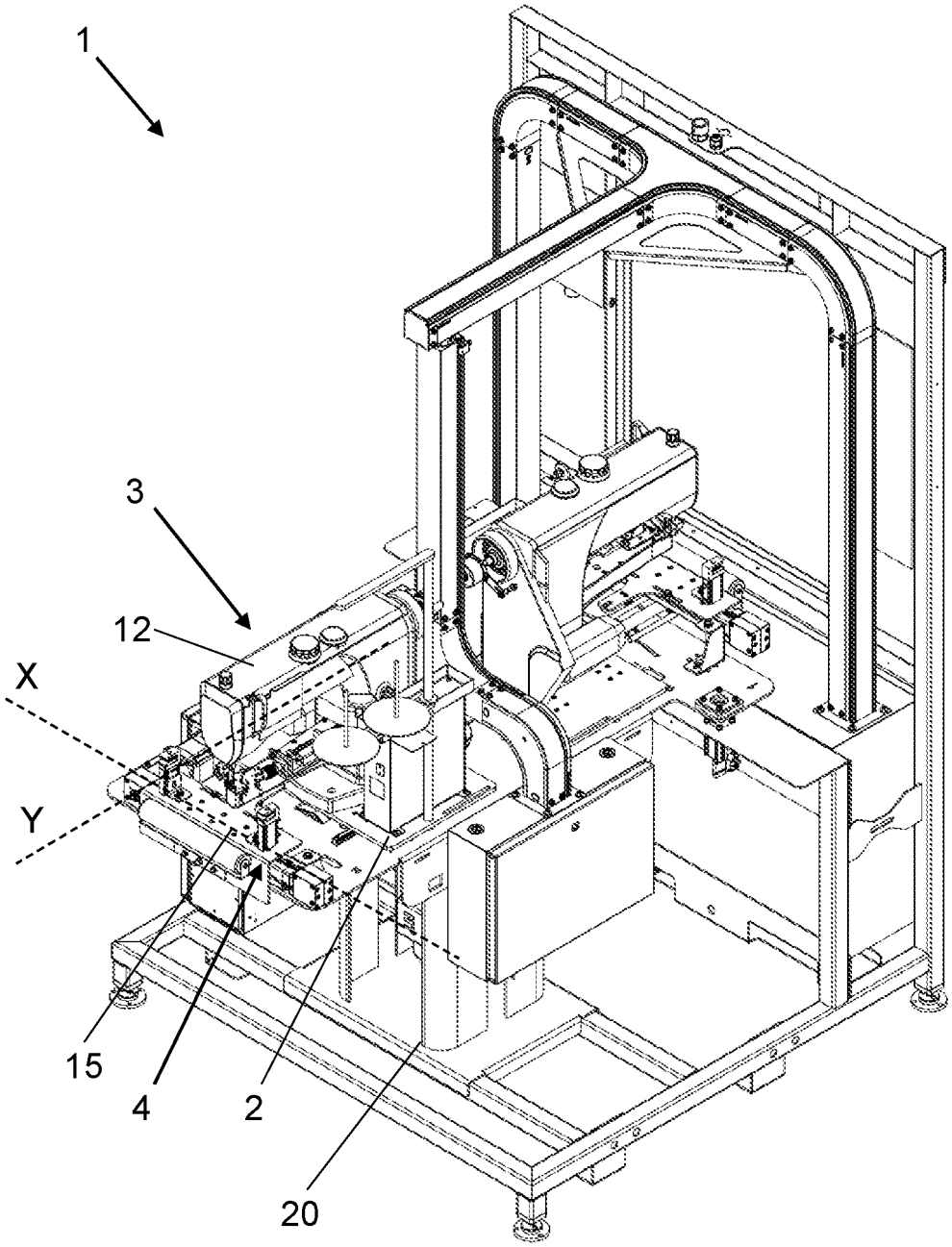
FIG. 1 shows a perspective view of the sewing machine according to the invention.
Figure 2A:
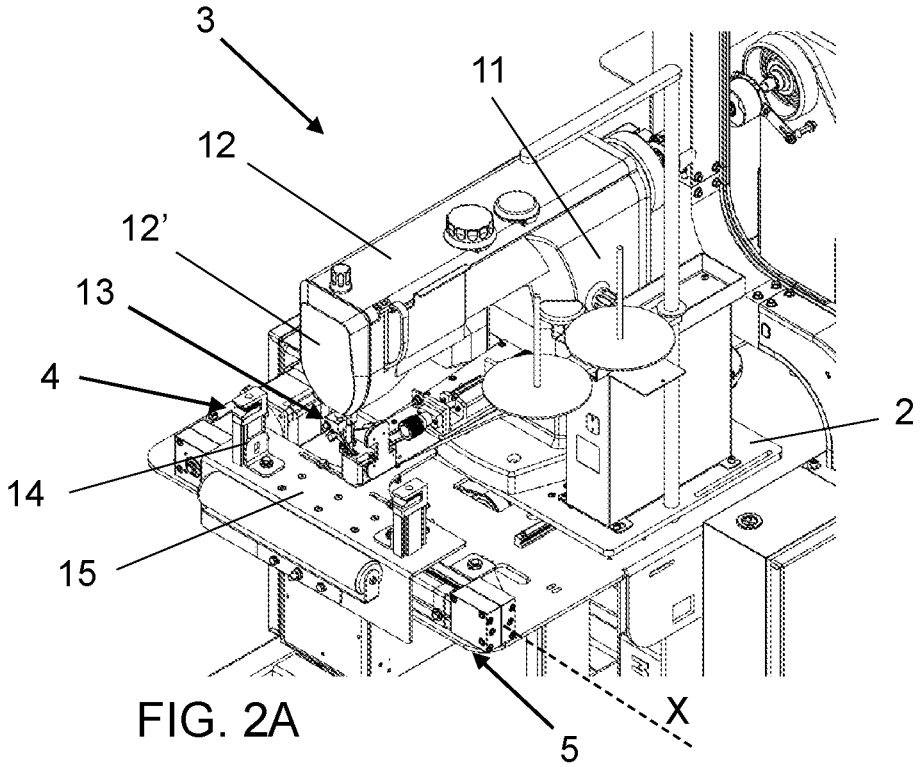
FIG. 2A is a perspective view of a detail of the machine of FIG. 1, concerning a sewing head.
Figure 2B:
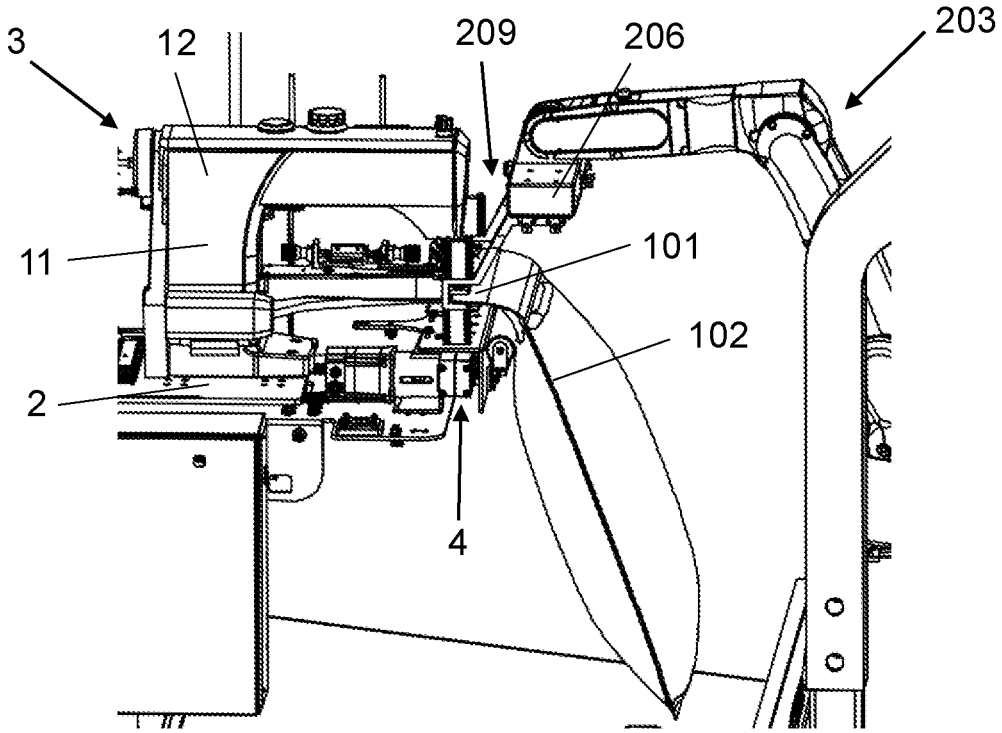
FIG. 2B shows a side view of a detail of the apparatus according to the invention, concerning a transfer device and the sewing head of the sewing machine.
Figure 3:
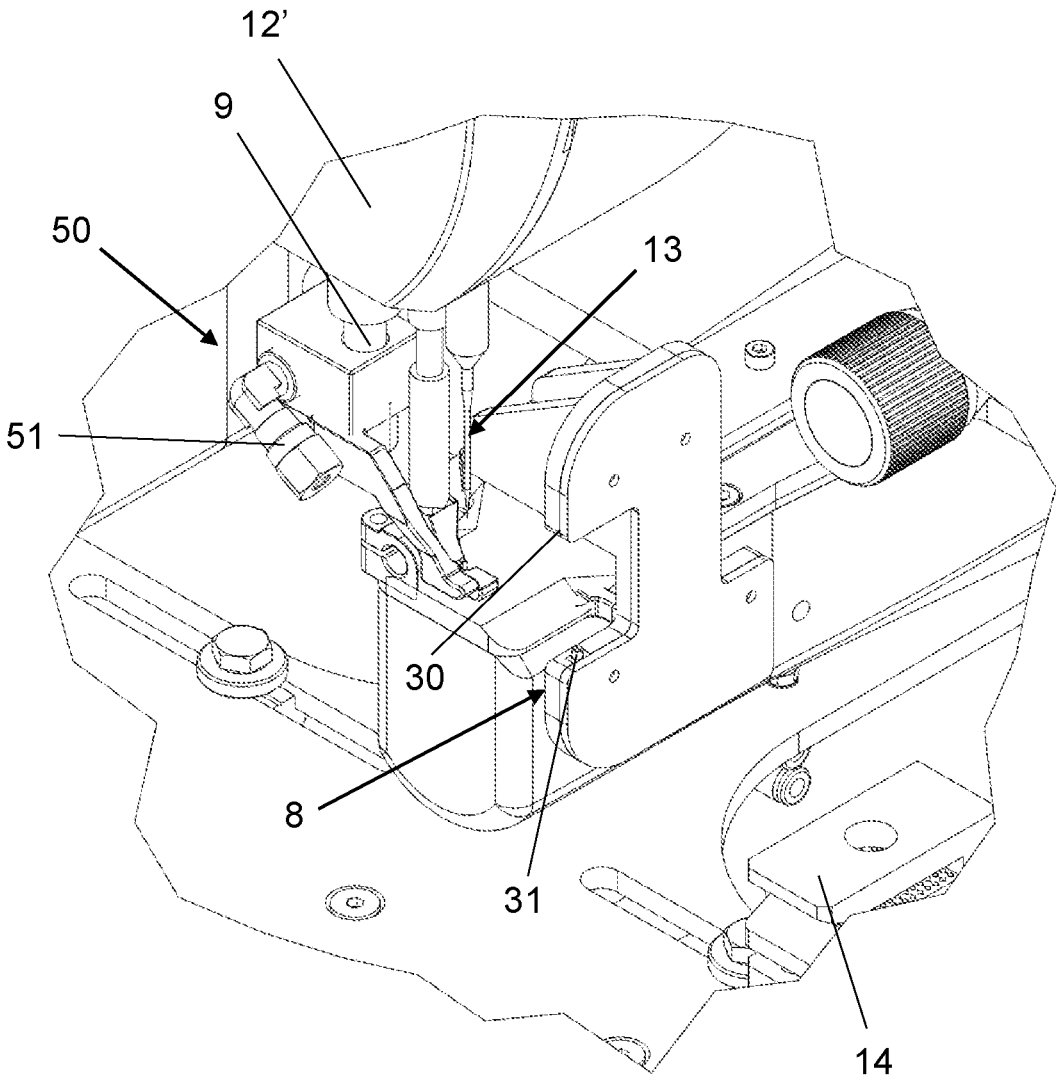
FIG. 3 shows in perspective view an enlargement of a detail of the machine of FIGS. 1 and 2A, concerning a first sensor of sensor means and holding means for the envelope.
Figure 4:
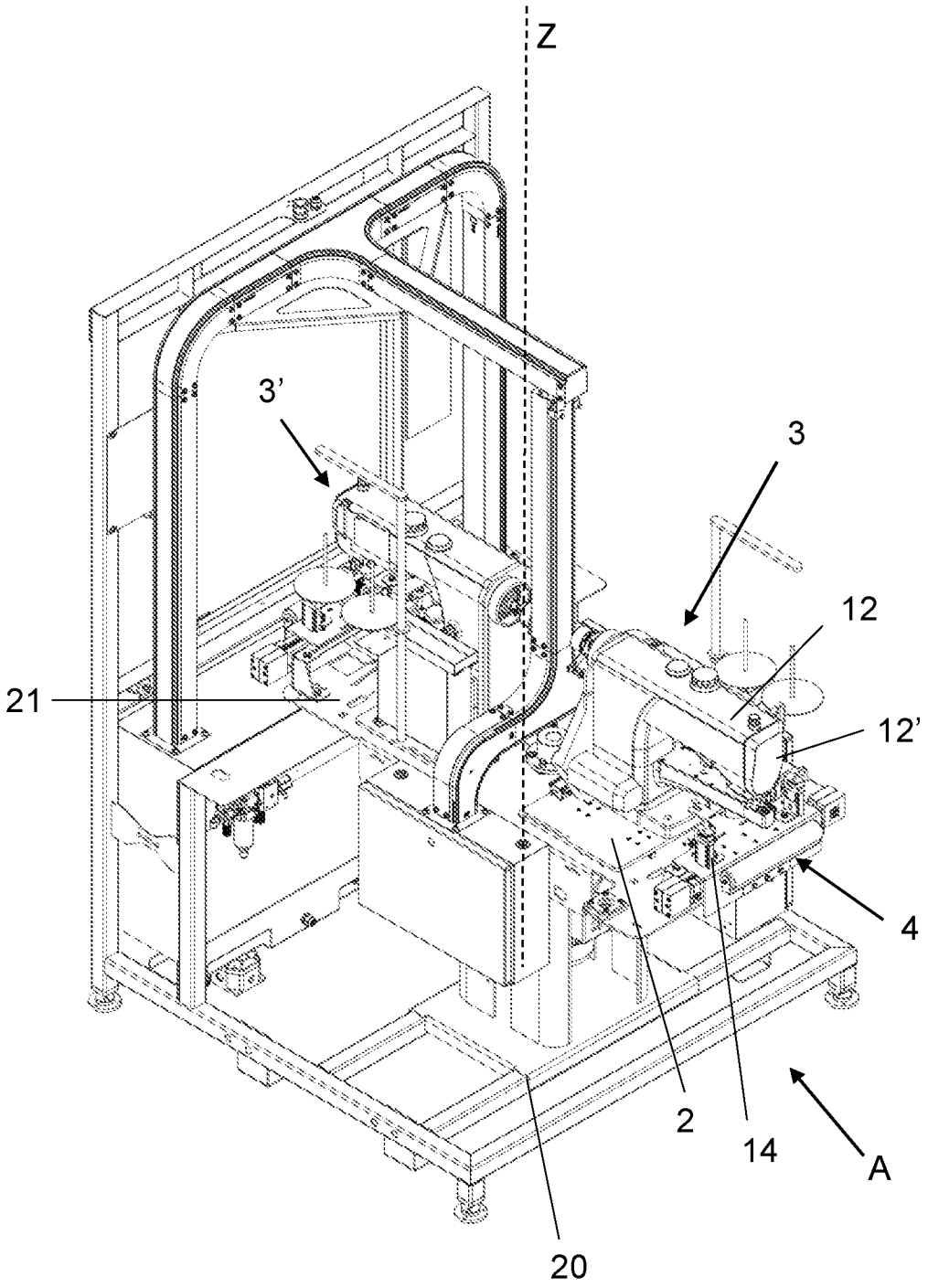
FIG. 4 shows in a further perspective view the sewing machine according to the invention.
Figure 5:
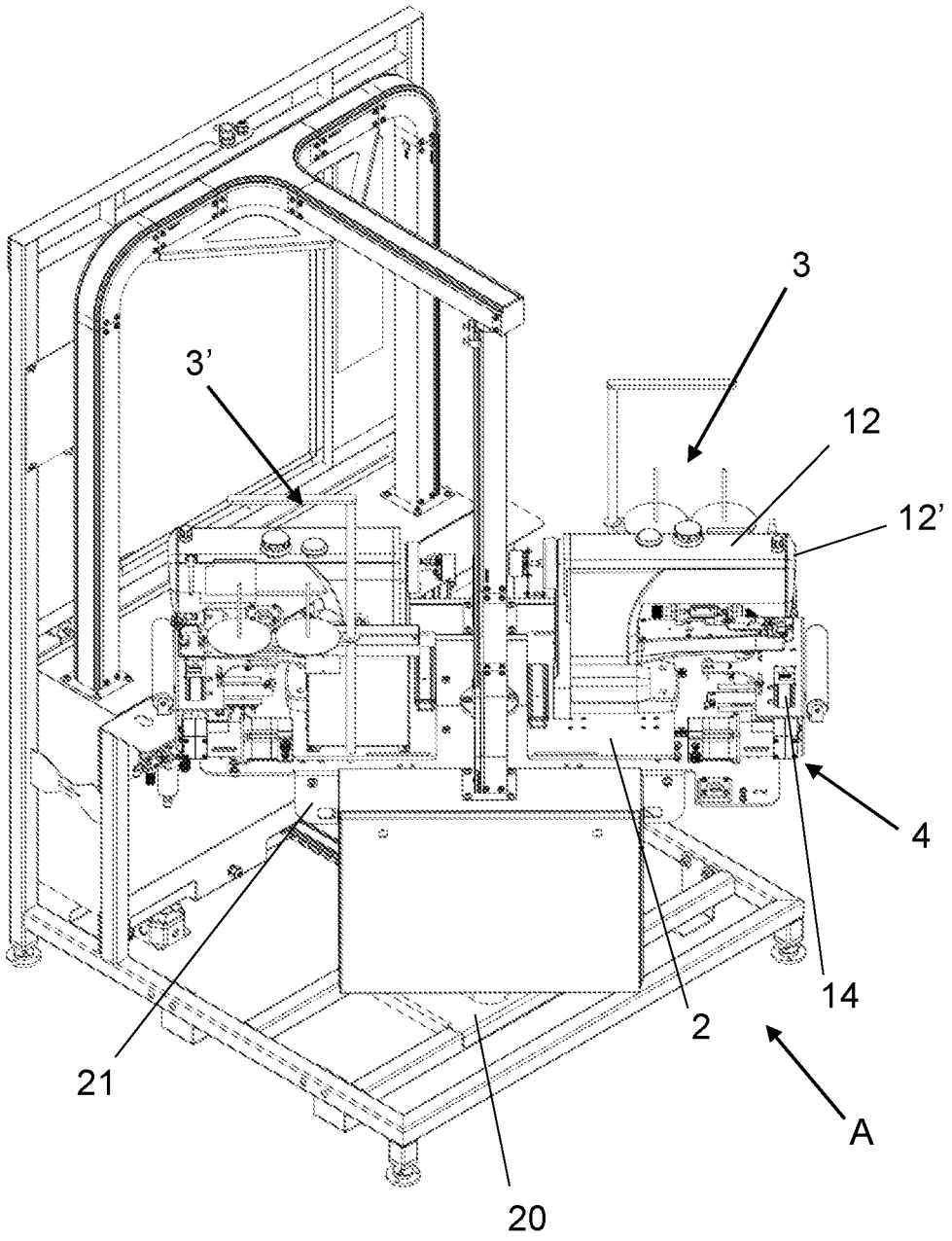
FIG. 5 shows in a further perspective view the sewing machine according to the invention of FIG. 4 with a movable portion of the support frame in its angular position.
Figure 6:
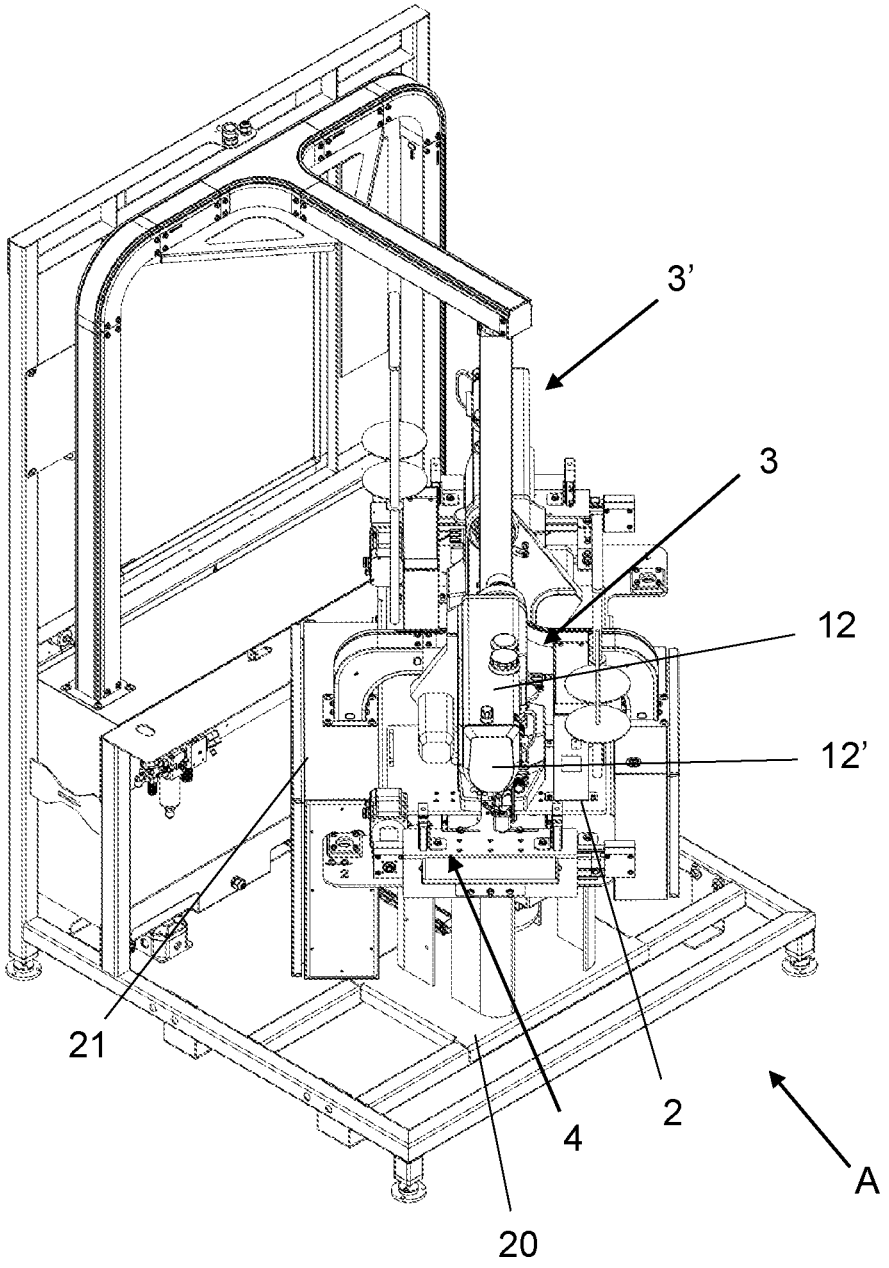
FIG. 6 shows in a further perspective view the sewing machine according to the invention of FIG. 4 with a movable portion of the support frame in a further angular position thereof.
Figure 7:
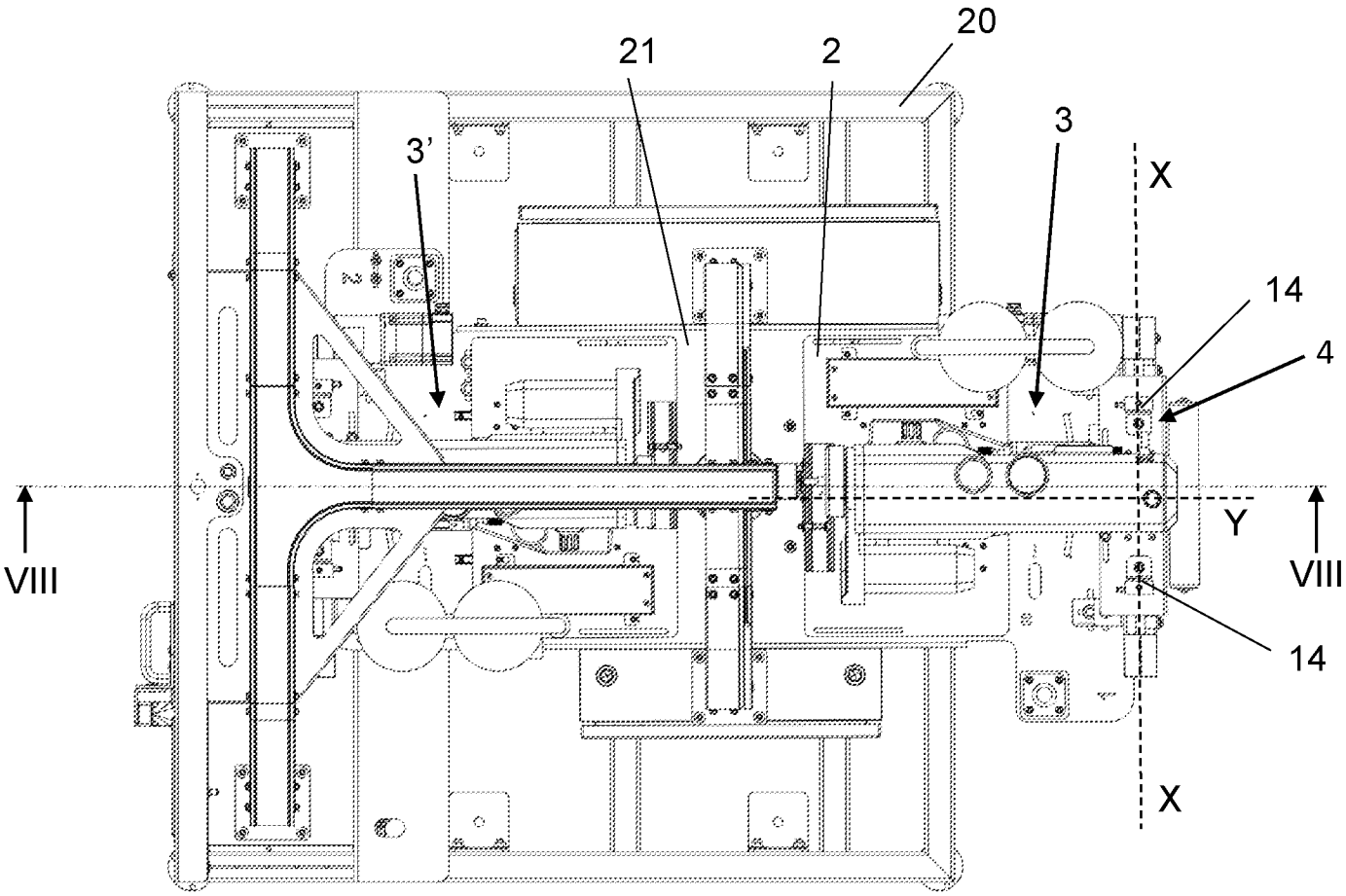
FIG. 7 shows a top plan view of the sewing machine according to the invention.

As can be seen from the figures, the sewing machine according to the invention—indicated as a whole with the reference number 1—is configured to make at least one sewing line on free flaps of a bag-like envelope, in particular to close an opening thereof, which has been used to fill that envelope with at least one padding material.

Preferably, the bag-like envelopes 100 to be sewn have an opening on at least one side and are closed on the remaining sides.

In particular, when empty, the bag-like envelopes 100 have a substantially "laminar" conformation, i.e. the extension of the thickness is much smaller than that of the other two dimensions (length and width). Therefore, suitably, at the opening, the free flaps 101 that delimit said opening must be mutually spaced so as to define a passage section suitable for allowing the entry of the padding material.

Conveniently, the envelopes 100 can be made of fabric, based on natural or synthetic fibers, leather, natural or synthetic, or other materials.

Preferably, the envelopes 100 consist of two portions 100', 100" facing each other and joined together along the entire perimeter with the exception of a section in which the free (i.e. not mutually joined) edges 101, of the two facing portions define/delimit the opening. Conveniently, said section with the free flaps 101 can involve in whole or in part—preferably at least the central area—of one side of the envelope 100.

Preferably, the envelopes 100 are pillow covers to be filled with feathers, or other soft materials such as wool, wadding or felt or synthetic fibers, such as expanded polystyrene, however they may comprise other bags to be filled and padded, such as training bags for boxing, or pieces of furniture that need padding, or clothing including padded parts such as goose down, or quilted blankets.

The machine for sewing bag envelopes 100, in particular for sewing envelopes 100 in correspondence with the opening delimited by the aforementioned two free overlapping flaps 101, comprises at least a support base 2 and a sewing head 3 mechanically mounted on the base support 2, configured to make a seam line on the free flaps 101 of the bag envelope 100 along a seam direction.

Preferably, the machine 1 comprises a support frame 20, intended to be placed on the ground, which carries the aforementioned support base 2, advantageously raised with respect to the ground.

The support frame 20 is advantageously made of metallic material, for example iron or steel and is preferably configured to be mechanically constrained to the ground, so that its position remains fixed, stable and constant over time.

The sewing head 3 is mounted on the support base 2, which advantageously provides at least one main section 11, which extends from the support base 2, preferably along a substantially vertical direction.

The sewing head 3 also preferably provides at least one longitudinal member 12, which extends transversely from the main trunk 11, along an advantageously horizontal direction.

The sewing machine 3 defines, between the side member 12 and the support base 2, an opening for receiving the aforementioned free flaps 101 of the envelope 100 to carry out the aforementioned sewing line.

For this purpose, at a free end 12' of the side member 12 of the sewing head 3 is advantageously mounted at least one sewing unit 13 advantageously facing the support base 2 and configured to make the aforementioned sewing line.

More in detail, in a manner known per se to the person skilled in the art, the sewing unit 13 comprises at least one needle facing the support base intended to engage at least one sewing thread to achieve the aforementioned sewing line, in a manner which itself well known to those skilled in the art and therefore not described in detail below.

The machine 1 according to the invention also comprises holding means 4 operatively associated with the sewing head 3 to retain the free flaps 101 of the envelope 100 in the bag.

Advantageously, the holding means 4 comprise at least one gripper 14, preferably arranged below the longitudinal member 12 of the sewing head 3.

In accordance with the preferential embodiment illustrated in the attached figures, the holding means 4 comprise two grippers 14 spaced apart along a substantially horizontal direction and configured to hold the free flaps 101 of the envelope 100 in correspondence with the sewing unit 13 of the head of sewing 3 at least during the realization of the sewing line.

The machine 1 according to the invention also comprises first movement means 5 operatively associated with the support base 2 and/or with the holding means 4 to achieve a relative movement between the sewing head 3 and the holding means 4 along a first direction, movement X substantially parallel to the sewing line to allow the sewing head 3 to realize the sewing line on the aforementioned free flaps 101.

Figure 8:
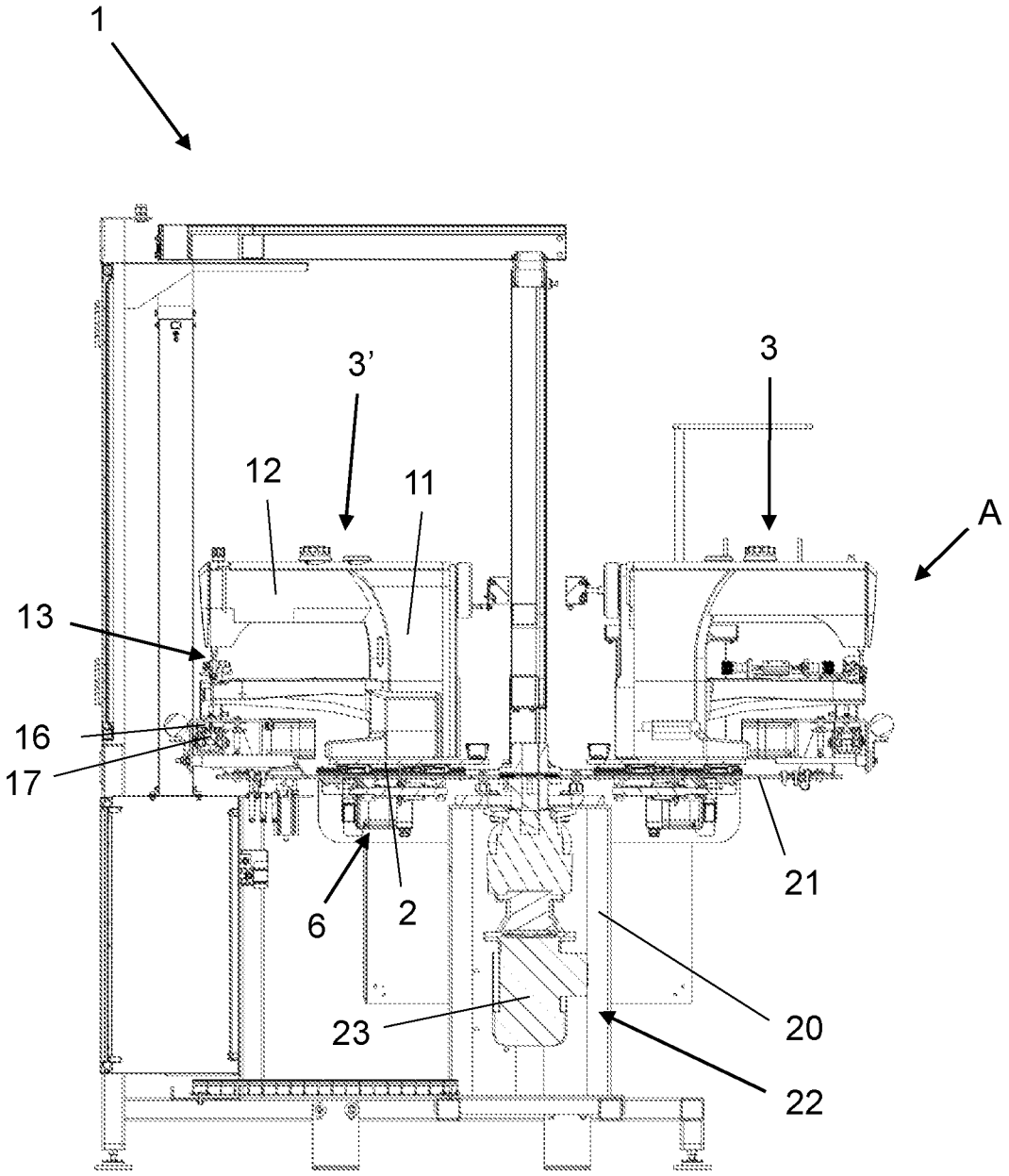
FIG. 8 shows a sectional side view of the machine according to the invention, made along the trace VIII-VIII of FIG. 7.

In accordance with the preferential but non-limiting embodiment illustrated in the attached figures, the first movement means 5 comprise at least one bracket 15 advantageously bearing mounted at least one said gripper 14 of the holding means 4 and at least one carriage 16 (visible in the attached FIG. 8) slidingly engaged to a rail 17 which extends parallel to the first direction of movement X.

According to the idea underlying the present invention, the machine 1 also comprises second movement means 6 for moving the sewing head 3 and/or the holding means 4 at least along a second movement direction Y substantially orthogonal with respect to the first movement direction X.

Advantageously, in accordance with the preferential embodiment illustrated in the attached figures, the first movement means 5 are configured to move the holding means 4 along the first movement direction X and the second movement means 6 are configured to move the feeding head, seam 3 along the aforementioned Y direction.

Obviously, this provision can be inverted, for example, in which the first movement means 5 are configured to move the sewing head 3 along the first movement direction X and the second movement means 6 are configured to move the holding means 4 along the aforementioned Y direction, without thereby departing from the scope of protection of this patent.

Similarly, the first and second movement means 5, 6 can be configured to move both the sewing head 3 and the holding means 4 along the first and second movement directions X, Y so as to achieve the aforementioned relative motion with synergistic movements of the head 3 and of the holding means 4.

Furthermore, according to the idea underlying the present invention, the sewing machine 1 comprises sensor means 7 operatively connected to the second movement means 6, comprising at least a first sensor 8 intended to be directed towards the free flaps 101 of the envelope 100 bag-shaped and configured to detect an extremal edge of the free flaps 101, preferably extending substantially parallel to the first direction of movement X.

Advantageously, the first sensor 8 of the sensor means 7 must be understood to be operatively connected to the first movement means 6 in the in sense of being operatively capable of following the relative movement along the second movement direction Y.

In the particular embodiment illustrated in the attached figures, the first sensor 8 is mechanically mounted on the sewing head 3, in particular mounted in correspondence with the sewing unit 13.

Advantageously, the first sensor 8 of the sensor means 7 is an optical sensor.

According to the idea underlying the present invention, the machine 1 further comprises at least one electronic control unit electronically connected at least with the sensor means 7 and with the second movement means 6 to control the second movement means 6 to generate the relative motion between the support base 2 and/or the holding means 4 for the envelope 100 along the second direction of movement Y at least for a predetermined portion.

In this way, the machine 1 object of the present invention makes it possible to create a sewing line on the free flaps 101 of the envelope 100 that is always the same for each different envelope 100, since the first sensor 8 of the sensor means 7 allows to detect the extremal edge and, synergistically with the electronic control unit, commands second sensor means to distance the sewing unit 13 with respect to this last edge.

Therefore, in fact the machine 1 object of the invention is able to obviate the drawbacks of the known art, in particular obviating possible fallacious embodiments due to the normal human error of an operator.

Conveniently, the electronic control unit comprises at least one programmable logic controller (PLC), to command, control and synchronize with each other at least the operation of the sensor means 7 and the second movement means 6.

Advantageously, the machine 1 comprises a user interface (not shown in the attached figures), preferably of the touch screen type, to allow the operator to set, start/stop, and in general command, control and manage the overall operation of the machine, with programming methods known per se to those skilled in the art and therefore not described in detail below.

Advantageously, the electronic control unit is programmed to move the support base 2 carrying the sewing head 3 along the second direction of movement Y at least starting from the extremal edge of the free flaps 101 of the bag-like envelope 100, detected by the first sensor 8 of said sensor means 7.

Operatively, the first sensor 8 of the sensor means 7 intercepts and detects the position of the extremal edge of the free flaps of the envelope 100 and starting from this position sends a corresponding first electrical signal, which is processed by the electronic control unit to send a corresponding second electrical signal to the second movement means 6 for moving the support base 2 along the second movement direction Y at least for the aforementioned predetermined section.

For example, in the case that the envelope 100 constitutes a cushion, the predetermined section may vary from a few millimeters to a few centimeters starting from the extreme edge of the free flaps 101.

Conveniently, in accordance with the embodiment illustrated in the attached figures, the electronic control unit is programmed to command the first movement means 5 to generate a relative movement between the sewing head 3 and the holding means 4 along the first direction, movement X in such a way that the sewing line is made at a substantially constant distance with respect to the extremal edge of the free flaps 101 and preferably at a distance substantially equal to the aforementioned predetermined portion.

In this way, the machine 1 object of the present invention makes it possible to create a perfectly straight and equally spaced seam line with respect to the extremal edge of the free flaps 100 of the envelope 100.

Conveniently, in order to achieve the aforementioned sewing line with greater precision, the machine 1 object of the present invention provides that the sensor means 7 comprise at least a second sensor 9 electronically connected to the electronic control unit and intended to be turned towards the edges 101 of the bag-like envelope 100 and configured to detect lateral edges 102 of the bag-like envelope 100 which laterally delimit the free flaps 101.

Advantageously, the electronic control unit is programmed to control the first movement means 5 to generate a relative movement between the sewing head 3 and the holding means 4 to form the sewing line between the side edges 102 of the bag envelope 100.

Operationally, the second sensor 9 is able to detect the lateral edges that laterally delimit the envelope 100 and to send a corresponding signal to the electronic control unit. The latter receives and processes this signal and emits a corresponding one to activate the sewing unit 13 to start the sewing line in correspondence with a first lateral edge or to stop the sewing unit 13 to interrupt the sewing line in correspondence with of the opposite side edge.

More clearly, the electronic control unit is preferably placed in data communication at least with the sensor means 7 and with the second movement means 6 and comprises at least one receiving module programmed to receive at least one from the first sensor 8 of the sensor means 7 first signal for detecting the extremal edge of said free flaps 101.

The electronic control unit also advantageously comprises at least one processing module programmed to process the first detection signal and generate a corresponding first command signal containing the value of the predetermined section starting from the extremal edge.

The electronic control unit advantageously further comprises a control module programmed to send the first control signal to the first movement means for moving the sewing head 3 and/or the holding means 4 along the first movement direction X at least for the aforementioned predetermined section.

Furthermore, preferably, the electronic control unit is placed in data communication with the first movement means 5 and the receiving module is programmed to receive from the second sensor 9 of the sensor means 7 at least a second detection signal of at least one of the side edges 102 of the bag-like envelope 100.

Furthermore, the processing module is preferably programmed to process the second detection signal and generate a corresponding second control signal.

Similarly, the control module is programmed to send the second control signal to the second movement means 6 to move the holding means 4 along the second movement direction Y to intercept the side edges 102 with the sewing head. 3 (and in particular with the sewing unit 13) and carry out the sewing line between the lateral edges 102 of the bag-like envelope 100.

Advantageously, the first movement means 5 and/or the second movement means 6 comprise at least one electric motor, electronically connected to the electronic control unit and capable of being activated to move the holding means 4 and/or the sewing head 3.

More in detail, the first movement means 5 comprise a worm screw mechanically associated with the support base 2 and with the electric motor for converting the rotary motion of the electric motor into a longitudinal motion advantageously parallel to the second movement direction Y.

Advantageously, the first sensor 8 of the sensor means 7 comprises at least a first emitter 30 and at least a first receiver 31, which define a space S between them. Conveniently, the space S is configured to be at least partially occupied by the free flaps 101 of the bag-like envelope 100. In other words, the free flaps 101 are intended to be substantially interposed between the first emitter 30 and the first receiver 31.

Figure 11:
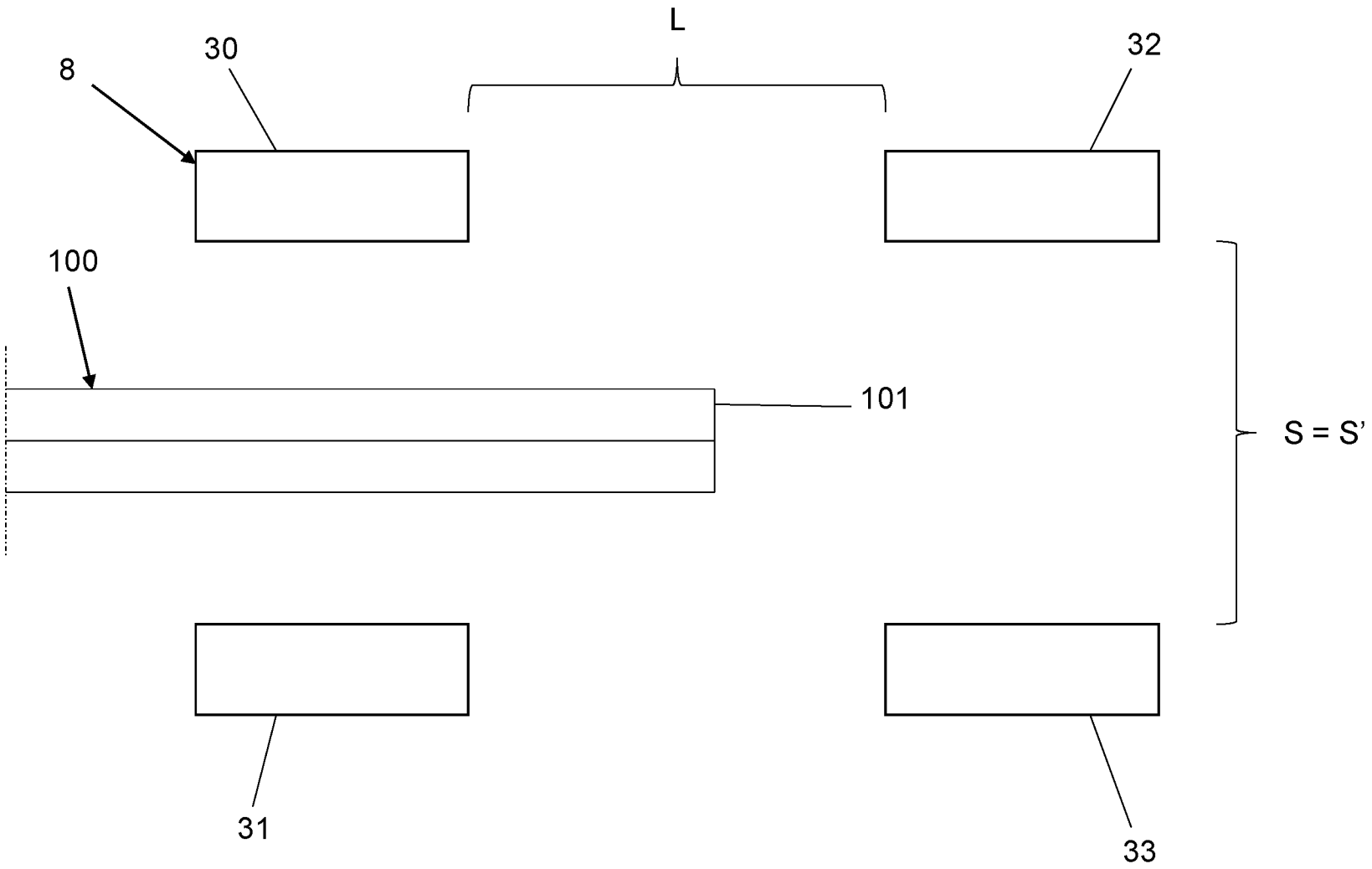
FIG. 11 shows a schematic view of the sensor means in a particular embodiment thereof.

In accordance with the particular embodiment illustrated in the attached FIG. 11, preferably, the first sensor 8 of the sensor means 7 further comprises a second emitter 32 and a second receiver 33.

Preferably, the second emitter 32 and the second receiver 33 are placed side by side with the first emitter 30 and the second receiver 31. Conveniently, the second emitter 32 and the second receiver 33 define a second space S' between them, preferably substantially equal to the defined space S between the first emitter 30 and the first receiver 31.

Preferably, the first space S and the second space S' have a linear distance, defined respectively between the first emitter and the first receiver 30, 31 and between the second emitter and the second receiver 32, 33, such as to allow the passage of the free flaps 101 of the bag envelope 100.

Advantageously, the first emitter 30 and the first receiver 31 are vertically aligned. Preferably, the second emitter 32 and the second receiver 33 are also vertically aligned and horizontally side by side with the first emitter and receiver 30, 31.

Conveniently, a volume with linear length L remains defined between the first emitter and receiver 30, 31 and the second emitter and receiver 32, 33.

Advantageously, the first emitter 30 and the second emitter 32 are configured to emit a corresponding first electromagnetic signal and a second electromagnetic signal.

Advantageously, moreover, the first receiver 31 and the second receiver 33 are configured to send a corresponding first electrical signal and a second electrical signal to the electronic control unit.

The first emitter 30 is preferably an optical emitter, configured to emit a first optical signal. Likewise, preferably the second emitter 32 is also an optical emitter, configured to emit a second optical signal.

Advantageously, the first receiver 31 is an optical receiver, in particular configured to receive the first optical signal emitted by the first emitter 31 and generate the corresponding first electrical reception signal and send it to the electronic control unit. Similarly, the second receiver 33 is also an optical receiver, in particular configured to receive the second optical signal emitted by the second emitter 32 and generate a corresponding second electrical reception signal and send it to the electronic control unit.

More in detail, the receivers 31, 33 send an electrical reception signal when they receive the corresponding electromagnetic signal from the corresponding emitter 30, 32 and a different non-reception electrical signal when they do not receive any signal from the emitters 30, 32.

The extreme edge of the free flaps 101 of the bag-like envelope 100 is preferably configured to remain arranged within the length L of the volume defined between the first emitter and receiver 30, 31 and the second emitter and receiver 32, 33.

In this way, the first electromagnetic signal, and in particular optical, emitted by the first emitter 30 intercepts the free edge 101 of the bag-like envelope 100 and does not reach the first receiver 31, which sends the corresponding electrical signal of no reception to the electronic control unit.

Otherwise, the second electromagnetic signal, and in particular optical, emitted by the second emitter 32 reaches the second receiver 33, which sends the corresponding second electrical reception signal to the electronic control unit.

The electronic control unit is suitably programmed to receive the electrical signal of the receivers 31, 33 of the first sensor 8 and send a corresponding command signal to the second movement means 6 to move the sewing head 3 and/or the holding means 4 along the second direction of movement Y to keep the free edge 101 interposed between the first emitter 30 and the first receiver 31.

In this way, the machine according to the invention allows the sewing line to be kept at a constant distance with respect to the extremal edge of the free parts 101 of the bag-like envelope 100 even if the extremal edge is not perfectly straight, for example if present curves or jaggedness or the like.

More in detail, the electronic control unit is configured to control the second movement means 6 so that the free flap 101 of the bag envelope 100 is interposed only between the first emitter 30 and the first receiver 31.

In other words, the electronic control unit is configured to control the second movement means 6 in such a way as to constantly receive the first electrical no-reception signal from the first receiver 31 and the second electrical reception signal from the second receiver 33. Preferably, the machine 1 according to the invention comprises cleaning means 50, mechanically mounted on the sewing head 3 and configured to clean the extremal edges of the free flaps 101.

Preferably, the cleaning means 50 are arranged upstream with respect to the sensor means 7 with respect to the direction of movement X of the envelope bag 100 during its sewing.

In this way, the cleaning means 50 remove any indentations or unwanted external bodies (such as, for example, portions of padding or the like) before they are erroneously detected by the sensor means 7, which could distort the detection of the sensor 8.

Advantageously, the cleaning means 50 comprise at least a blowing apparatus configured to emit, by means of a blowing head 51, a flow of pressurized air directed towards the aforementioned extremal edge of the free flaps 101, in particular to remove any unwanted objects present in correspondence of the extremal edge itself.

A further machine for sewing bag envelopes is also described below, which is of the same type as the machine described up to now and whose reference numbers will be maintained.

The machine 1 for sewing bag envelopes 100, according to the invention, is equipped with a front side A for the realization of said seam and comprises a support frame 20, a first sewing head 3 mechanically mounted on the support frame 20 in a first position with respect to the front side A, configured to make a seam line on free flaps 101 of the bag envelope 100 along a seam direction.

The machine 1 also comprises a second sewing head 3' mechanically mounted on the support frame 20 in a second position with respect to the front side A, configured to make a sewing line on the free flaps 101 of the bag-like envelope 100 along the direction of seam.

Obviously, all the above characteristics with particular reference to the sewing head 3 also refer to the same sewing heads 3, 3' of the machine described therein.

According to the idea underlying the present invention, the support frame 20 includes at least a movable portion 21. The first sewing head 3 and the second sewing head 3' are mechanically mounted on this movable portion 21.

Furthermore, according to the idea underlying the present invention, the machine 1 further comprises actuator means 22 mechanically associated with the movable portion 21 of the support frame 20 to move it in at least a first working configuration in which the first sewing head 3 is placed at the front side A and a second working configuration in which the second sewing head 3' is located at the front side A itself.

In this way, the machine object of the present invention makes it possible to change a sewing head 3 which requires maintenance with a second sewing head 3' which is perfectly functional in a quick and simple way, without the need to stop the machine 1 for a long period of weather.

In fact, as soon as the first head 3 requires maintenance, the actuator means 22 are activated to move the mobile portion from the first working configuration to the second working configuration in order to immediately continue the sewing operations with the second sewing head 3'.

In fact, the first head 3 can be subject to maintenance during normal operation of the second head 3', obviating the drawback of lengthening production times due to an unwanted machine downtime.

Advantageously, the movable portion 21 of the support frame 20 extends mainly along a main lying plane and defines an upper surface, on which the first sewing head 3 and the second sewing head 3' are mechanically mounted, and a lower surface, facing away from the upper surface.

Conveniently, moreover, in accordance with the preferential embodiment illustrated in the attached figures, the actuator means 22 are mechanically connected to the lower surface of the movable portion 21.

Obviously, the actuator means can be provided mechanically connected to the upper surface of the movable portion 21 without thereby departing from the scope of protection of this patent.

Advantageously, the movable portion 21 of the support frame 20 is rotatable around a substantially vertical central axis Z, at least between a first angular position in the first working configuration and a second angular position in the second working configuration.

The actuator means 22 preferably comprise at least one motor 23 mechanically connected to the lower surface of the movable portion 21 of the support frame 20 and operable to rotate the movable portion 21 between the first angular position and the second angular position.

More in detail, the actuator means also comprise at least one hub 24 constrained to the lower surface of the movable portion 21 of the support frame and constrained in form coupling with a transmission shaft of the motor 23, which shaft advantageously develops parallel to the central axis Z, i.e. substantially vertically.

Preferably, the first sewing head 3 and the second sewing head 3' are mounted specular to each other with respect to the central axis Z.

More in detail, the first angular position and the second angular position are diametrically opposite to each other with respect to the central axis Z.

In accordance with a further embodiment of the present invention, the machine 1 may comprise three or more sewing heads 3, preferably mounted on the movable portion 21 of the support frame 20 in order to allow the head 3 located at the front side A to be changed more than once, in case more than one sewing head needs maintenance at the same time.

Furthermore, all the characteristics of the aforementioned first sewing machine refer to the sewing machine described up to now.

In particular, the support base 2 and the holding means 4 can be mechanically mounted on the mobile portion 21 of the support frame 20.

In this way, it is possible to make a machine 1 equipped with both the aforementioned advantages of precision in the production of the sewing line and the advantages described herein of reliability in the event of failures, being able to quickly change the sewing head in the case of maintenance.

The present invention also relates to an apparatus 200 for handling bag-shaped envelopes 100, in particular of envelopes provided with an opening delimited by two free overlapping flaps 101, which according to the idea underlying the invention comprises at least one machine 1 for sewing bag envelopes 100 described above, of which the same reference numbers will be kept for simplicity of explanation.

According to the invention, the apparatus 200 comprises at least one filling station 201, equipped with filling means 202 to fill the envelope 100 in a bag with at least one padding material.

Preferably, the filling station 201 is configured for example to insert, by means of an injection mouth 207, a stuffing material (feathers, wool, cotton, or other, preferably soft, materials) into the envelopes 100 to be filled, for example into the linings, in order to obtain pillows.

Operationally, the apparatus according to the invention—indicated as a whole with the reference number 200—is configured for the manipulation and management of bag containing envelopes 100 and, in particular, is configured to take at least one empty envelope 100 at a time from at least one stack of said envelopes provided at a first station, and transferring the collected envelope to a second station which is equipped with a machine designed to carry out a processing or operation on said envelope, preferably for filling said envelope with a material of padding.

Furthermore, the apparatus comprises at least one transfer device 203 configured to transfer at least one envelope 100 from said at least one filling station 201 to at least one said sewing machine 1.

The transfer device 203 is advantageously configured to take a single envelope 100, from the injection mouth 207 of the filling station 201, and transfers it to the sewing machine 1 in which the subsequent processing/manufacturing operation of the sewing line on the free flaps 101 on the single envelope 100 picked up and handled.

Preferably, the transfer device 203 acts on the envelope 100 having the two free flaps 101, which delimit the opening, which have been partially separated so as to cause a first expansion, preferably partial, of the opening which thus defines a first section passage for the padding material.

For example, the aforementioned expansion of the flaps 101 can take place manually, through the action of an operator who takes a envelope 100 from a stack of empty envelopes 100 and positions them with the opening engaged by the injection mouth 201 of the filling station 201 for their filling.

In accordance with a further embodiment of the present invention, the transfer device 203 is configured to position the envelope 100 at the filling station 201 so that the injection mouth 207 of the latter enters the opening of the envelope 100, by spreading the free flaps 101 of the two facing portions of the envelope 100.

Advantageously, the transfer device 203 is provided with a gripping head 206.

Preferably, the transfer device 203 is a robotic manipulator, for example a robotic arm, or of the anthropomorphic type and/or of the type used in the industrial context, equipped with a fixed end mounted on a lower base 208 and a movable end, opposite to the fixed end, which carries the gripping head 206 mounted. Conveniently, the robotic manipulator is mounted on the base 208 which, advantageously, can be provided with means (not shown) for its movement. Preferably, the robotic manipulator has a structure with at least 4 degrees of freedom.

Conveniently, in a different embodiment not shown, the transfer device 203 comprises a suitable frame with handling units equipped with actuators and configured to rotate the gripping head 66 around corresponding axes and/or to make it translate along corresponding guides so as to cause the transfer of said head between the first station 33 and the second station 34.

Gripping means 209 are mounted on the gripping head 206 for gripping a wrapper 100 at the filling station 201 and for retaining it during its transfer to the sewing machine 1. In particular, at the filling station 201 the gripping means 209 act on the envelope 100 to release it from the injection port 207.

Conveniently, the gripping means 209 are configured to clamp the envelope 100 so as to make it integral with the gripping head 206, which is mounted, to the movable end of the transfer device 203. Preferably, the gripping means 209 are configured to clamp the envelope 100 coming into contact with the external surfaces of the two portions that make up the envelope itself.

Advantageously, it comprises centering means 204 operatively associated with the transfer device 203, configured to arrange the free flaps 101 of the envelope 100 in a bag in a predetermined position with respect to the sewing head 3 of the sewing machine 1.

More in detail, the centering means 204 comprise at least one movable member, which is mounted on a gripping head 206 of the transfer device 203, and is movable between a first compact configuration in which said movable member has a smaller overall dimensions than to the opening of the envelope 100 to thus allow its insertion into the opening, and a second dilated configuration in which the movable member has the same or greater overall dimensions than the opening so as to engage the envelope 100 in correspondence with its lateral edges 102; the envelope 100 is thus arranged, with respect to the gripping head 206, in a predetermined reciprocal position.

Preferably, the electronic control unit is electronically connected to the transfer device 203 and is programmed to move the gripping head 206 with the movable member in the expanded configuration near the holding means 4 of the sewing machine 1, in the aforementioned predetermined position.

In this way, the apparatus 200 allows you to move each envelope 100 and position it in correspondence with the sewing machine 1 in a predetermined position centered with the sewing head 3 to create the sewing line automatically.

Advantageously, centering means 204 are mounted on the gripping head 206 and are configured to fit into the opening of the envelope 100 to keep the edges 101 of said envelope 100 spaced apart once the envelope 100 is released and/or it is detached/disassociated from the injection mouth 207 of the filling station 201 to be moved towards the sewing machine 1.

Advantageously, the centering means are also configured to cause an expansion of the free flaps 101 of the two portions of the envelope 100 so that the opening, delimited by said two free flaps, allows the passage inside the injection mouth 207.

Figure 9:
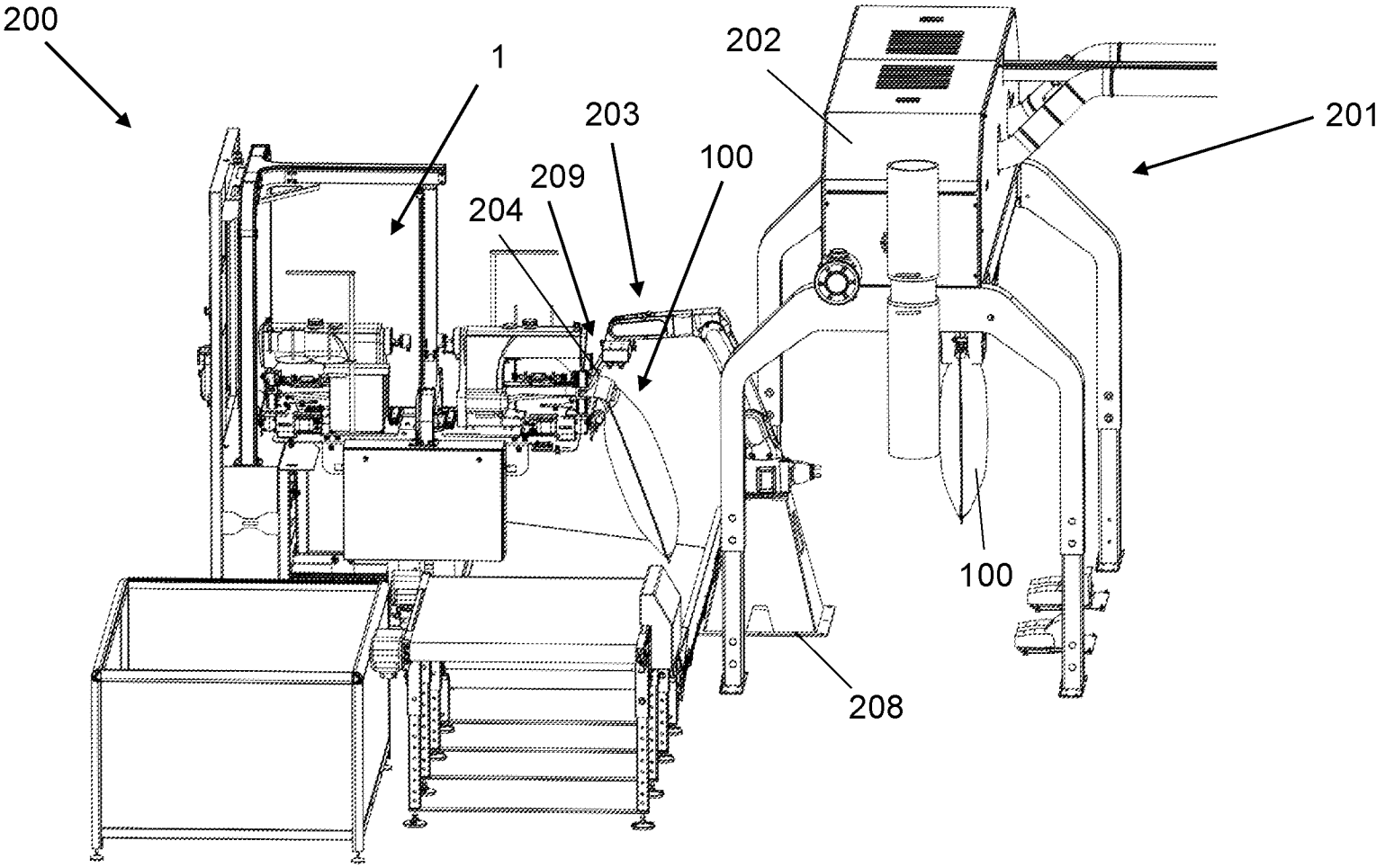
FIG. 9 is a perspective view of an apparatus for handling bag-like envelopes according to the present invention.
Figure 10:
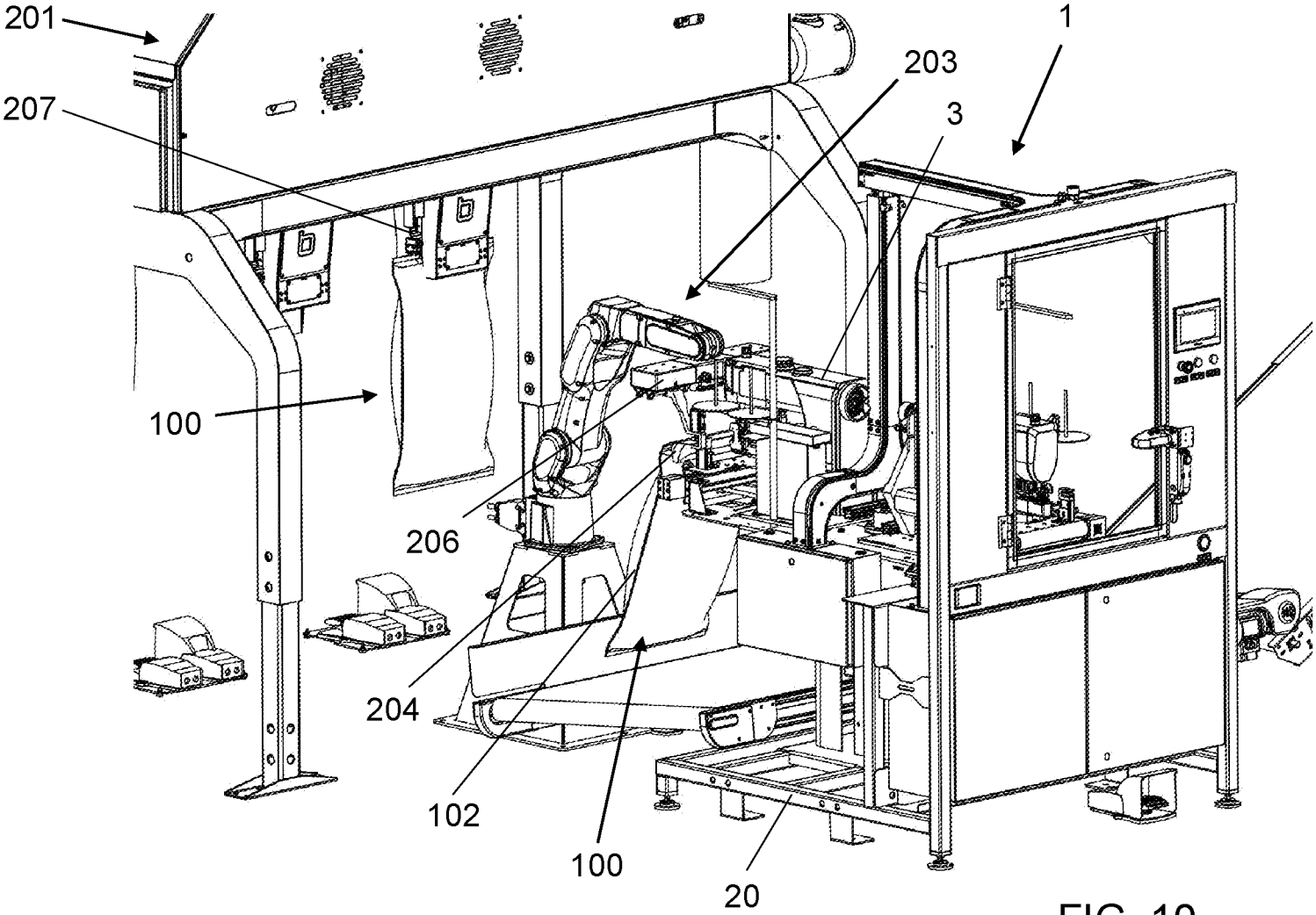
FIG. 10 shows in a further perspective view the apparatus for handling bag envelope according to the present invention.

Conveniently, the transfer device 203 is configured to move the gripping head 206 between the filling station 201 and the sewing machine 1, as well as to cause the gripping head 206 to move between a first orientation (to be assumed at the station filling 201, not shown) and a second orientation (to be assumed in correspondence with the sewing machine, see FIGS. 9 and 10).

Preferably, in said first orientation, the gripping head 206 is substantially arranged vertically to keep the envelope raised with respect to the ground and associated with the injection mouth 207 of the filling means 202 of the filling station 201. Preferably, however, when it is in said second orientation (see FIGS. 9 and 10), the gripping head 206 is substantially arranged horizontally and is perpendicular to the removed envelope which, being held by the gripping means 209 of the head itself, hangs vertically.

As mentioned, the centering means are mounted on the gripping head 206, which have (at least) a basic configuration in which the means themselves define (discontinuously or continuously) an insertion section, which is preferably smaller than the opening of the envelope 100, to thus allow the insertion of the centering means within the opening itself.

Advantageously, the presence of the centering means also allows to maintain the dilated condition of the two free flaps 101 by engaging the envelope in the same way for each envelope engaged by the centering means of the centering means.

Conveniently, the movable member of the centering means is made by means of at least one pair of spreading arms which with their ends define the overall dimensions of said insertion section and which, once inserted in said opening of the envelope 100, are intended to come into contact with the internal surface of said envelope 100, in correspondence with the lateral edges 102 to engage the envelope 100 always in the same reciprocal position with respect to the gripping head 206. Preferably, the arms of each pair are movable in mutual approach and distance.

Advantageously, the spreader arms can have a curved outer end and, preferably, the apex of the arms is slightly folded inwards.

Advantageously, the presence and action of the spreading arms of the centering means also allows maintaining the spread configuration of the two free flaps 101 of the envelope 100, even during the transfer of the envelope—which has been gripped by the gripping means 209—from filling station 201 to sewing machine 1.

Conveniently, the passage section of said opening obtained and maintained following the action of the spreading arms is such as to allow the insertion, inside said opening, of the injection mouth 207 of the filling means 202 for filling provided in the filling station 201.

Conveniently, the actuations of the gripping means 209 and of the centering means 204 mounted on the gripping head 206 are motorized and, advantageously, are controlled to be automated and synchronized with the movements of the transfer device 203.

Advantageously, the actuation of the gripping means 206 and the centering means 204 is commanded and controlled by a control and command unit on the basis of the measurements made by a suitable sensor system mounted on the gripping head 206 and on the transfer device 203.

Preferably, the apparatus 200 comprises a second electronic control unit of the transfer device 203. Conveniently, said second electronic control unit is connected to the electronic control unit of the sewing machine 1 and communicate with each other to synchronize the movement of the transfer device 203 and to allow a correct centering of each envelope 100 by engaging with the centering means 204. Conveniently, the second unit is configured to command and control the gripping means 209 and the centering means 204 of the gripping head 206.

Advantageously, the apparatus 200 can comprise a single electronic control unit configured to control and command both the sewing machine 1 and the transfer device 203 and its gripping head 206.

From what has been said it is clear that the sewing machine and the apparatus for handling bag envelopes according to the invention are particularly advantageous as:

- it is operationally completely reliable and in particular it allows realizing a large number of seams obviating the risk of creating different sewing lines;
- it requires scarce maintenance interventions and therefore allows to obtain a high efficiency in the realization of the casings;
- it can also be used with existing and operational machines and/or systems;
- it is simple and easy to use, as well as reducing maintenance interventions;
- it can be used with casings of substantially any shape, size, material and/or fabric.
- it has an alternative characterization, both in constructive and functional terms, compared to traditional ones;
- it can be used and installed in line in plants for the production of pillows or the like;
- it allows to obtain cushions of high quality standard;
- it can be created simply, quickly and with low costs.
- allows fully automated handling of pouch wraps, preferably empty liners to be filled with a padding material to obtain corresponding cushions,
- allows precise, and even complex, handling of bag wrappers,
- allows you to handle casings of different sizes and/or different materials and, in particular, also of different fabrics, The present invention has been illustrated and described in one of its preferred embodiments, but it is understood that executive variations may be applied to it in practice, without however departing from the scope of protection of this patent for industrial invention.

The invention claimed is:

1. Machine for sewing bag-like envelopes (100), in correspondence with an opening delimited by two free overlapping flaps (101), the machine (1) comprising:

- a support base (2);
- a sewing head (3) mechanically mounted on said support base (2), configured to make a sewing line on said free flaps (101) of said bag-like envelope (100) along a sewing direction;
- holding means (4) operatively associated with said sewing head (3) for retaining said free flaps (101) of said bag-like envelope (100);
- first movement means (5) operatively associated with said support base (2) and/or with said holding means (4) to achieve relative movement between said sewing head (3) and said holding means (4) along a first direction of movement (X) substantially parallel to said sewing line to allow said sewing head (3) to realize said sewing line on said free flaps (101);
- second movement means (6) for moving said sewing head (3) and/or said holding means (4) at least along a second movement direction (Y) substantially orthogonal with respect to said first movement direction (X);
- sensor means (7) operatively connected to said second movement means (6), comprising at least a first sensor (8) intended to face the free flaps (101) of said bag-like envelope (100) and configured to detect an extremal edge of said free flaps (101), extending substantially parallel to said first direction of movement;
- at least one electronic control unit electronically connected at least with said sensor means (7) and with said second movement means (6) for controlling said second movement means (6) to generate said relative motion between said sewing head (3) and said holding means (4) for said envelope (100) along said second direction of movement (Y) at least for a predetermined portion;

wherein said electronic control unit is programmed to command said first movement means (5) and said second movement means (6) to generate a relative movement between said sewing head (3) and said holding means (4) along said first movement direction (X) and said second movement direction (Y) in such a way that said sewing line is made at a substantially constant distance with respect to said extremal edge of said free flaps (101) and at a distance substantially equal to said predetermined portion, and wherein said first sensor (8) of said sensor means (7) comprises at least a first emitter (30) and at least a first receiver (31), which define a space between them (S).

2. The machine according to claim 1, wherein said electronic control unit is programmed to move said support base (2) carrying said sewing head (3) along said second direction of movement (Y) at least starting from said extremal edge of said free flaps (101) of said bag-like envelope (100), detected by said first sensor (8) of said sensor means (7).

3. The machine according to claim 1, wherein said sensor means (7) comprise at least a second sensor (9) electronically connected to said electronic control unit and intended to be turned towards the free flaps (101) of said envelope (100) and configured to detect lateral edges (102) of said pouch-like envelope (100) which laterally delimit said free flaps (101).

4. The machine according to claim 3, wherein said electronic control unit being programmed to control said first movement means (5) to generate a relative movement between said sewing head (3) and said holding means (4) to achieve said seam line between said lateral edges (102) of said bag-like envelope (100).

5. The machine according to claim 3, wherein said electronic control unit is placed in data communication at least with said sensor means (7) and with said second movement means (6) and comprises:

a receiving module programmed to receive from the first sensor (8) of said sensor means (7) at least a first detection signal of said extremal edge of said free flaps (101);

a processing module programmed to process said first detection signal and generate a corresponding first command signal containing the value of said predetermined portion starting from said extremal edge;

a control module programmed to send said first control signal to said first movement means (5) to move said sewing head (3) and/or said holding means (4) along said first movement direction (X) at least for said predetermined section.

6. The machine according to claim 5, wherein said electronic control unit is placed in data communication with said first movement means (5) and wherein:

the receiving module is programmed to receive from the second sensor (9) of said sensor means (7) at least a second detection signal of at least one of said lateral edges (102) of said bag-like envelope (100);

the processing module is programmed to process said second detection signal and generate a corresponding second command signal;

the control module is programmed to send said second control signal to said second movement means (6) to move said holding means (4) along said second movement direction (Y) to intercept said lateral edges (102) with said sewing head (3) and carrying out said sewing line between said lateral edges (102) of said envelope (100).

7. The machine according to claim 1, wherein said space (S) is configured to be at least partially occupied by the free flaps (101) of said bag-like envelope (100).

8. The machine according to claim 1, wherein said free flaps (101) of said bag-like envelope (100) are configured to be substantially interposed between the first emitter (30) and the first receiver (31) of said first sensor (8).

9. The machine according to claim 1, wherein said first sensor (8) of said sensor means (7) further comprises a second emitter (32) and a second receiver (33).

10. The machine according to claim 9, wherein the second emitter (32) and the second receiver (33) are placed side by side with the first emitter (30) and the second receiver (31).

11. The machine according to claim 9, wherein said first emitter (30) and the first receiver (31) are vertically aligned and wherein the second emitter (32) and the second receiver (33) are aligned vertically and horizontally flanked by the first emitter and receiver (30, 31).

12. The machine according to claim 9, wherein between the first emitter and receiver (30, 31) and the second emitter and receiver (32, 33) a volume with linear length (L) remains defined.

13. The machine according to claim 12, wherein said extremal edge of said free flaps (101) of said bag-like envelope (100) is configured to remain disposed within said length (L) of the volume defined between the first emitter and receiver (30, 31) and the second emitter and receiver (32, 33).

14. The machine according to claim 9, wherein said first emitter (30) and said second emitter (32) are configured to emit a corresponding first electromagnetic signal and a second electromagnetic signal;

and wherein said first receiver (31) and said second receiver (33) are configured to send a corresponding first electrical signal and a second electrical signal to the electronic control unit.

15. The machine according to claim 9, wherein said first and second receivers (31, 33) send an electrical reception signal when receiving a corresponding electromagnetic signal from the corresponding first or second emitter (30, 32) and a different electrical no-reception signal when receiving no signal from the emitters (30, 32).

16. The machine according to claim 10, wherein said electronic control unit is programmed to receive the electrical signal of the receivers (31, 33) of said first sensor (8) and send a corresponding command signal to second movement means (6) for moving the sewing head (3) and/or the holding means (4) along the second movement direction (Y) in such a way as to receive the first electrical no-reception signal from the first receiver (31) and the second electrical reception signal from the second receiver (33).

17. Machine for sewing bag-like envelopes (100), in correspondence with an opening delimited by two free overlapping flaps (101), the machine (1) comprising:

a support base (2);

a sewing head (3) mechanically mounted on said support base (2), configured to make a sewing line on said free flaps (101) of said bag-like envelope (100) along a sewing direction;

holding means (4) operatively associated with said sewing head (3) for retaining said free flaps (101) of said bag-like envelope (100);

first movement means (5) operatively associated with said support base (2) and/or with said holding means (4) to achieve relative movement between said sewing head (3) and said holding means (4) along a first direction of movement (X) substantially parallel to said sewing line to allow said sewing head (3) to realize said sewing line on said free flaps (101);

second movement means (6) for moving said sewing head (3) and/or said holding means (4) at least along a second movement direction (Y) substantially orthogonal with respect to said first movement direction (X);

sensor means (7) operatively connected to said second movement means (6), comprising at least a first sensor (8) intended to face the free flaps (101) of said bag-like envelope (100) and configured to detect an extremal edge of said free flaps (101), extending substantially parallel to said first direction of movement;

at least one electronic control unit electronically connected at least with said sensor means (7) and with said second movement means (6) for controlling said second movement means (6) to generate said relative motion between said sewing head (3) and said holding means (4) for said envelope (100) along said second direction of movement (Y) at least for a predetermined portion;

wherein said electronic control unit is programmed to command said first movement means (5) and said second movement means (6) to generate a relative movement between said sewing head (3) and said holding means (4) along said first movement direction (X) and said second movement direction (Y) in such a way that said sewing line is made at a substantially constant distance with respect to said extremal edge of said free flaps (101) and at a distance substantially equal to said predetermined portion, and further comprising cleaning means (50), mechanically mounted on the sewing head (3) and configured to clean the extremal edges of the free flaps (101).

18. The machine according to claim 17, wherein said cleaning means (50) comprise at least blowing apparatus configured to emit, by means of a blowing head (51), a flow of pressurized air directed towards said extremal edge of the flaps free (101).

19. Apparatus (200) for handling bag-like envelopes (100), equipped with an opening delimited by two free overlapping flaps (101), the apparatus comprising at least one machine (1) for sewing envelopes (100) pouch according to claim 1;

said apparatus (200) comprising:

at least one filling station (201), equipped with filling means (202) to fill said envelope (100) in a bag with at least one padding;

at least one transfer device (203) configured to transfer at least one envelope (100) from said at least one filling station (201) to at least one said sewing machine (1).

20. Machine for sewing bag-like envelopes (100), in correspondence with an opening delimited by two free overlapping flaps (101), the machine (1) comprising:

a support base (2);

a sewing head (3) mechanically mounted on said support base (2), configured to make a sewing line on said free flaps (101) of said bag-like envelope (100) along a sewing direction;

holding means (4) operatively associated with said sewing head (3) for retaining said free flaps (101) of said bag-like envelope (100);

first movement means (5) operatively associated with said support base (2) and/or with said holding means (4) to achieve relative movement between said sewing head (3) and said holding means (4) along a first direction of movement (X) substantially parallel to said sewing line to allow said sewing head (3) to realize said sewing line on said free flaps (101);

second movement means (6) for moving said sewing head (3) and/or said holding means (4) at least along a second movement direction (Y) substantially orthogonal with respect to said first movement direction (X);

sensor means (7) operatively connected to said second movement means (6), comprising at least a first sensor (8) intended to face the free flaps (101) of said bag-like envelope (100) and configured to detect an extremal edge of said free flaps (101), extending substantially parallel to said first direction of movement;

at least one electronic control unit electronically connected at least with said sensor means (7) and with said second movement means (6) for controlling said second movement means (6) to generate said relative motion between said sewing head (3) and said holding means (4) for said envelope (100) along said second direction of movement (Y) at least for a predetermined portion;

wherein said electronic control unit is programmed to command said first movement means (5) and said second movement means (6) to generate a relative movement between said sewing head (3) and said holding means (4) along said first movement direction (X) and said second movement direction (Y) in such a way that said sewing line is made at a substantially constant distance with respect to said extremal edge of said free flaps (101) and at a distance substantially equal to said predetermined portion, and wherein said first sensor (8) of said sensor means (7) comprises:

at least a first optical emitter (30) configured to emit a first optical signal, and at least a first optical receiver (31) configured to receive the first optical signal emitted by the first emitter (31) and generate a corresponding first electrical reception signal and send it to the electronic control unit.

* * * * *